US007637539B2

(12) United States Patent
McKee et al.

(10) Patent No.: US 7,637,539 B2
(45) Date of Patent: Dec. 29, 2009

(54) COILED TUBING DIMPLE CONNECTION

(75) Inventors: L. Michael McKee, Friendswood, TX (US); Frank F. Espinosa, Richmond, TX (US); William D. Eatwell, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 530 days.

(21) Appl. No.: 11/425,748

(22) Filed: Jun. 22, 2006

(65) Prior Publication Data

US 2007/0000669 A1 Jan. 4, 2007

Related U.S. Application Data

(60) Provisional application No. 60/695,584, filed on Jun. 30, 2005.

(51) Int. Cl.
*F16L 13/14* (2006.01)

(52) U.S. Cl. ..... 285/256; 285/382; 166/242.6

(58) Field of Classification Search ..... 285/236, 285/256, 382; 166/77.2, 242.2, 242.6, 380; 403/274, 279, 282
See application file for complete search history.

(56) References Cited

U.S. PATENT DOCUMENTS

| | | | | | |
|---|---|---|---|---|---|
| 587,695 | A * | 8/1897 | Billing et al | 285/114 |
| 1,223,591 | A * | 4/1917 | Layne | 285/15 |
| 1,995,616 | A * | 3/1935 | Kamack | 285/289.3 |
| 2,300,517 | A * | 11/1942 | Milton | 29/828 |
| 2,647,770 | A * | 8/1953 | Tollefsbol | 277/605 |
| 5,348,088 | A | 9/1994 | Laflin | |
| 5,524,937 | A | 6/1996 | Sides | |
| 5,829,795 | A * | 11/1998 | Riesselmann | 285/256 |
| 6,059,338 | A * | 5/2000 | Diederichs | 285/55 |
| 6,474,701 | B1 | 11/2002 | Bowles | |
| 7,152,674 | B2 * | 12/2006 | Bowles | 166/242.6 |
| 7,237,809 | B2 * | 7/2007 | Connell | 285/382 |
| 7,484,772 | B2 * | 2/2009 | Thorensen | 285/190 |
| 2004/0045704 | A1 * | 3/2004 | Bowles | 166/242.7 |
| 2004/0184871 | A1 * | 9/2004 | Luft et al. | 403/300 |
| 2005/0248151 | A1 * | 11/2005 | Connell | 285/286.2 |
| 2006/0157974 | A1 * | 7/2006 | Luft et al. | 285/223 |
| 2006/0243453 | A1 * | 11/2006 | McKee | 166/380 |
| 2007/0235198 | A1 * | 10/2007 | Parker | 166/380 |
| 2008/0047716 | A1 * | 2/2008 | McKee et al. | 166/384 |
| 2008/0169094 | A1 * | 7/2008 | Ehtesham et al. | 166/77.2 |

OTHER PUBLICATIONS

BD Kendle Engineering Limited; "Coiled Tubing Tools—Section 3: Inline Connectors"; printed Mar. 23, 2007, www.bdkendle.co.uk/Coiled_Tubing.*

* cited by examiner

*Primary Examiner*—James M Hewitt
(74) *Attorney, Agent, or Firm*—Michael Flynn; David Cate; Robin Nava

(57) ABSTRACT

A connection between coiled tubing and a connector includes a plurality of dimples formed by a tubing, each dimple is disposed within a respective pocket formed in a connector to form at least two rows of dimple-pocket connections, wherein the fit of the dimples within the pockets of the rows graduates from tighter to looser along the length of the connection. The connection may further include a seal member positioned between the tubing and the connector positioned between at least two of the rows of dimple-pocket connections formed. A method of connecting coiled tubing to a connector includes the steps of graduating the dimple-pocket connections from tighter to looser along the length of the connection.

17 Claims, 5 Drawing Sheets

COILED TUBING DIMPLE CONNECTION

This application claims the benefit of U.S. Provisional Patent Application No. 60/695,584 filed Jun. 30, 2005.

FIELD OF THE INVENTION

The present invention relates in general to coiled tubing and more specifically to connecting coiled tubing with a connector.

BACKGROUND

It is often necessary to provide a connector with coiled tubing. This need occurs when a downhole tool needs to be attached to the end of a string of coiled tubing. It also occurs when the amount of coiled tubing required to perform the service cannot be contained on a single reel as one continuous length of pipe. This could be a result of lift capacity of handling equipment or the volume capacity of the work reel. Additional examples of oilfield circumstances that require a connector include situations such as repairing a leak or a damaged area in an existing continuous length of coiled tubing or retrieving a length of coiled tubing (such as a velocity string) from a well.

One method of connecting a connector to coiled tubing is by deforming the coiled tubing into preformed pockets on the outside diameter of the connector. By connecting the connector to the coiled tubing with this method, a strong secure connection is made that can resist both tensile loads and torsion loads. A connector that can be used for this application needs to provide tensile strength similar to the strength of the coiled tubing. In the case of a spoolable connector, the connector is also required to bend around the coiled tubing reel and the injector gooseneck during operation. This bending and straightening sequence causes low cycle fatigue in the coiled tubing and the connector.

Problems that occur when using dimples to connect coiled tubing to a connector include, but are not limited to, evaluating tensile strength of the connection and providing a solid connection that does not restrict bending of the coil around the reel or gooseneck when two sections of coiled tubing are connected together. For connectors attached to the end of a string of coiled tubing a pull test can be conducted on the connector with the injector. This validates the integrity of the connector for the applied load, but material often yields and could compromise the connection. This test does not determine the pull apart limit of the connection. When two sections of coiled tubing are connected together using dimples it is not possible to perform a pull test that validates the strength of the connection.

Currently the size and depth of the dimple is not controlled. Dimples are commonly formed by using a hydraulic ram that presses a pin with a spherical end into the surface of the coiled tubing, yielding the coiled tubing material into a preformed dimple on the connector OD. The force used to make the dimple is controlled by adjusting the hydraulic pressure applied to the ram. This pressure is commonly set high enough to insure that all tubing strengths and thicknesses can be fully dimpled with a set force per pin. Since coiled tubing is supplied in various yield strengths and wall thicknesses, the amount of deformation and yielding can vary when dimpled with a standard force per pin. Testing has shown that dimples that are too shallow or too deep result in a connection that can fail from tensile loads and bending loads significantly before connections that are made with the preferred dimple depth. Therefore, it is important to know if a dimple has been properly formed.

If the preformed dimple in the connector body is slightly larger than the dimpling pin, then the dimple will sufficiently fill the cavity to make a secure connection. If all of the dimples in the coiled tubing fit snuggly in the preformed pockets of the connector, then a tensile load is not carried uniformly, overstressing some of the dimples as shown in FIG. 1. FIG. 1 illustrates a prior art connector-coiled tubing connection wherein some of the dimples are overstressed. Connector 12 is connected to coiled tubing 14 via dimples 18 formed in coiled tubing 14 and mated with pockets 16 (see FIG. 2) preformed in connector 12. Coiled tubing 14 is overstressed proximate dimples 18 at the shaded regions 20.

Another drawback of the prior art dimple connections is illustrated in FIG. 2. When the preformed pocket 16 in connector 12 is significantly larger in radius and volume, as shown in FIG. 2, then its respective dimple 18 does not completely fill the pocket cavity 22 and the connection is loose, allowing connector 12 to move slightly relative to coiled tubing 14. This produces a gap 24 between the connector shoulder 26 and coiled tubing 14. Gap 24 can cause problems when the connector assembly passes through the coiled tubing stripper. For a conventional spoolable connector, both of these conditions, overstressed and gap, can cause problems leading to reduced performance.

Therefore, there is a desire to provide an improved dimple connection for coiled tubing and method of providing coiled tubing dimple connection integrity that addresses drawbacks of the prior art systems and methods. There is a further desire to provide a method of validating the strength of a connection while allowing flexibility in the connection to enhance low cycle fatigue performance during bending. There is a still further desire to provide a secondary barrier without compromising the performance of the primary seal.

SUMMARY OF THE INVENTION

In view of the foregoing and other considerations, the present invention relates to coiled tubing and more specifically to connecting coiled tubing with connectors.

Accordingly, connections between coiled tubing and connectors and methods of connecting coiled tubing to connectors are provided. In one embodiment a connection between coiled tubing and a connector includes a plurality of dimples formed by a tubing, each dimple is disposed within a respective pocket formed in a connector to form at least two rows of dimple-pocket pocket connections, wherein the fit of the dimples within the pockets of the rows graduates from tighter to looser along the length of the connection. The connection may further include a seal member positioned between the tubing and the connector positioned between at least two of the rows of dimple-pocket connections formed.

An embodiment of a method of connecting coiled tubing to a connector includes the steps of disposing a portion of coiled tubing over a connection section of a connector, forming dimples in coiled tubing such that each dimple is disposed within a respective pocket formed in the connection section providing dimple-pocket connections between the coiled tubing and connector and controlling the depth that each of the dimples penetrates the respective pocket such that the connection between the coiled tubing and connector progresses from tighter to looser along the length of the connection section. Desirably at least two rows of dimple-pocket connections are formed, wherein the fit of the dimple-pocket connections in the same row are substantially the same. It may further be desired to provide a seal between the tubing and the connector positioned between at least two of the rows of dimple-pocket connections.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
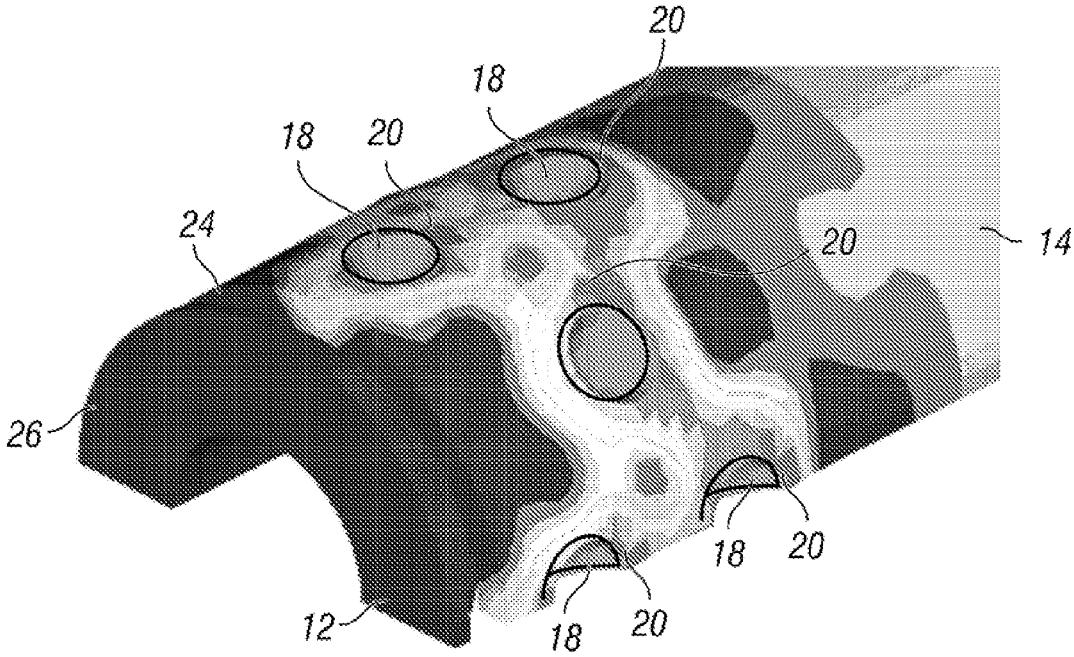
FIG. 1 (Prior Art)
FIG. 1 is an illustration of a prior art dimple connection showing the overstressed regions of the coiled tubing proximate the dimples.

Refer now to the drawings wherein depicted elements are not necessarily shown to scale and wherein like or similar elements are designated by the same reference numeral through the several views.

The present invention provides graduated fit dimple connections between connectors and coiled tubing and methods for validating the strength of a connection while allowing flexibility in the connection to enhance low cycle fatigue performance during bending. A secondary barrier without compromising the performance of the primary seal is also disclosed.

In general terms, the present invention ensures a secure connection by measuring the depth of the dimples formed in coiled tubing when connecting a connector and a section of coiled tubing together. Further, by controlling the depth of the dimple in the coiled tubing and the diameter and depth of the preformed pockets in the connector, the fit between the coiled tubing and connector can be controlled and graduated. The present invention includes graduated fit dimple connections and methods wherein dimples fit snugly in one set of pockets, providing a secure connection, and the dimples in a next set fit loosely in another set of pockets, which enhances the ability of the coiled tubing to bend around the reel and gooseneck at the connection. The graduated fit dimple connections of the present invention improves the low cycle fatigue life of the coiled tubing and connection. A secondary seal may also be incorporated with the dimple pattern by cutting an O-ring groove in a serpentine pattern between two rows of dimples.

Figure 3:
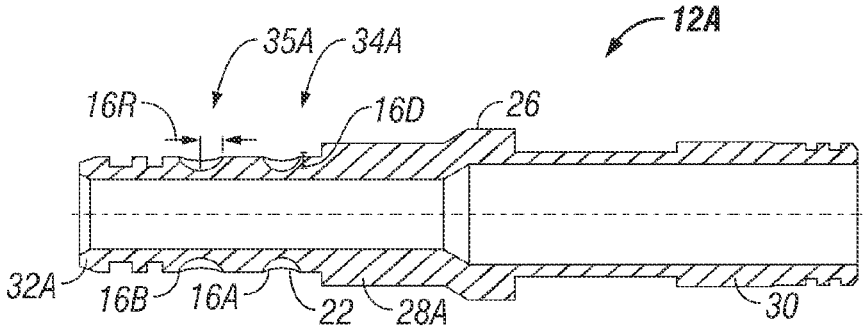
FIG. 3 is a cross-sectional view of an end connector for coiled tubing.

FIG. 3 is a cross-sectional view of an end connector, identified by 12*a*. End connector 12 includes a first connection section 28*a* for connecting with the coiled tubing and a tool end 30 adapted for connecting with a tool or other device not shown. First connection section 28*a* extends from connector shoulder 26 to a terminal end 32*a*. At least two rows of pockets 16 are formed on first connection section 28*a*. First row 34*a* includes pockets 16*a* that are spaced circumferentially about first section 28*a* and that are positioned proximate to shoulder 26 relative to the additional rows of pockets. Second row 35*a* includes a row of pockets 16*b* spaced circumferentially about first section 28*a* between first row 34*a* and terminal end 32*a*. Connector 12 may include additional rows of pockets numbered sequentially toward terminal end 32*a*. Each pocket 16 forms a cavity 22 having a depth 16D and a radius 16R. For each row, pockets 16 have substantially the same depth 16D and radius 16R. As will be better understood with the following description, the depth 16D and/or radius 16R may vary between subsequent rows of pockets 16 to facilitate a graduated fit dimple connection. It should be noted however, that the graduated dimple connection may be accomplished via the sizing of the dimples for the respective rows 34 of pockets 16.

Figure 4:
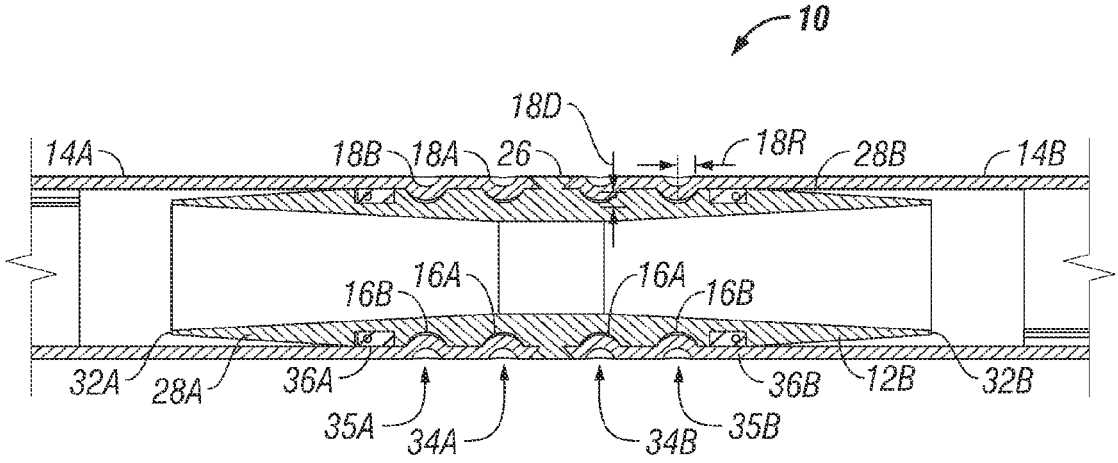
FIG. 4 is a cross-sectional view of an embodiment of a dimple connection of a spoolable connector in between two sections of coiled tubing of the present invention.

FIG. 4 is a cross-sectional view of an embodiment of a graduated dimple connection 10 of the present invention. The embodiment illustrated in FIG. 4 shows a spoolable connector, identified as 12*b*, connected to a first coiled tubing section 14*a* and a second coiled tubing section 14*b*. As opposed to end connector 12*a* of FIG. 3, spoolable connector 12*b* includes a first connection section 28*a* and a second connection section 28*b*. First connection section 28*a* is adapted for connecting to first coiled tubing section 14*a* and second connection section 28*b* is adapted for connecting to second coiled tubing section 14*b*. Second connection section 28*b* is substantially a mirror image first connection section 28*a* including at least two rows 34*b* and 35*b* of pockets 16*a* and 16*b* respectively. It should be further noted that each connection section 28 may include a primary seal 36 positioned between connector 12 and tubing 14 and terminal end 32*a* and the last row of dimples and pockets (row 35 in FIG. 4).

Creating graduated dimple connection 10 of FIG. 4 will now be described with reference to first connection section 28*a* with the understanding that substantially the same process is performed for second connection section 28*b*. First connection section 28*a* is disposed within first coiled tubing section 14*a* such that coiled tubing 14*a* substantially abuts shoulder 26. A dimple 18 is then created, such as by a dimple tool 42 described with reference to FIG. 8, in coiled tubing 14 so as to be disposed in a respective pocket 16. For example, in first row 34*a* a dimple 18*a* is formed in coiled tubing 14*a* for each pocket 16*a*. Each dimple 18 forms a ridge having a depth 18D and a radius 18R.

To create the graduated dimple connection 10, first row 34*a* of pockets 16*a* and dimples 18*a* has a different fit than the second row 35*a* of dimples 16*b* and pockets 18*b*. In the illustrated embodiments, dimples 18*a* fit relatively snugly within pockets 16*a* to form a tight or snug fit first row 34*a*. The dimple-pocket connections in second row 35*a* have a looser fit than those of first row 34*a*, in other words the depth 18D and/or radius 18R of the dimples of the second row 35*a* diverge more from their respective pocket depths 16D and/or radius 16R than those of first row 34*a*. It should be noted that the dimple-pocket connections do not have to graduate to a different fit between two adjacent rows, but that graduation or progressively looser fitting rows of dimple-pocket connections must be formed along the length of connection section 28. For example, an additional row (not shown) of dimple-pocket connections may be positioned between row 34*a* and 35*a* of FIG. 4, with this additional row being out of phase with first row 34*a* and having the same dimple-pocket fit as that of first row 34*a*.

Dimples 18*a* of first row 34*a* fit snuggly from side to side in their respective first row 34*a* pockets 16*a* providing a solid connection between coiled tubing section 14*a* and connector 12*b* that does not have substantially any axial play (slop). Dimples 18*b* of second row 35*a* fit loosely within their respective pockets 16*b* relative to the connections of first row 34*a*. The looser fit of second row 35*a* allows for some movement of coiled tubing 14*a* relative to connector 12*b* in the region of second row 35*b*. By graduating the dimple-pocket fit along connector section 28, dimples 16 of each row load more uniformly than in prior dimple connections.

Figure 2:
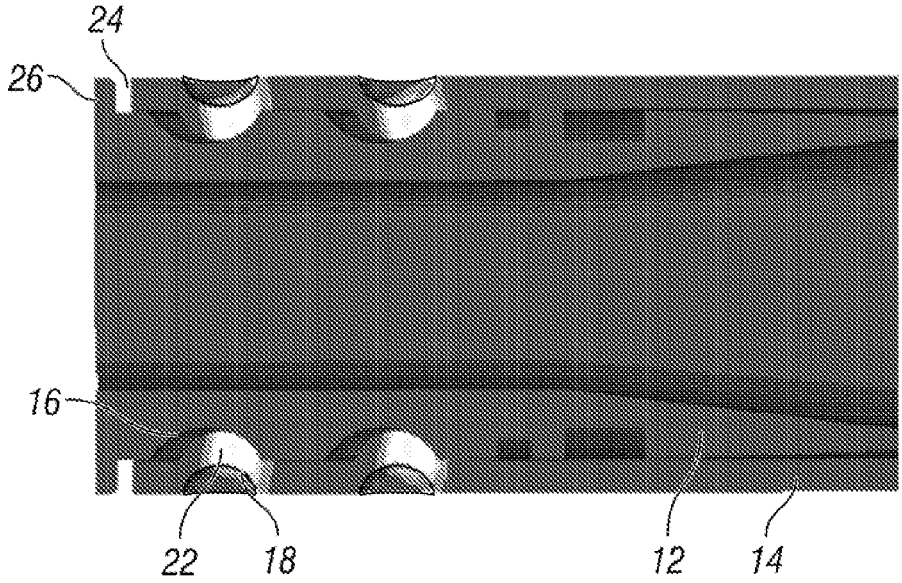
FIG. 2 (Prior Art)
FIG. 2 is an illustration of another drawback of prior dimple connections.
Figure 5:
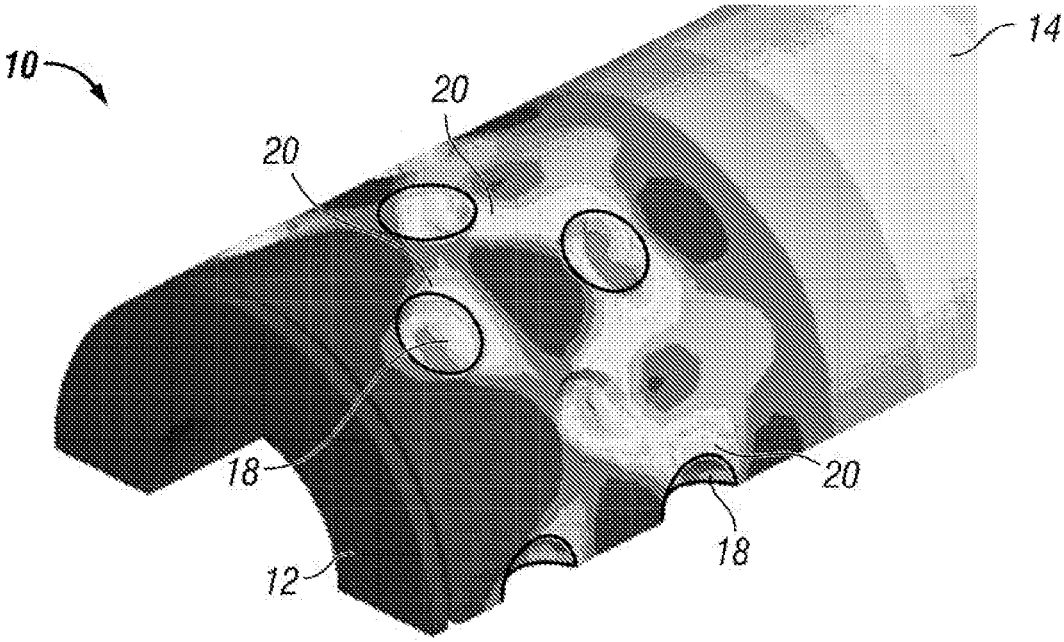
FIG. 5 is an illustration of the stress in a dimple connection of the present invention relative to the prior art connection illustrated in FIG. 2.

Referring to FIG. 5, stress is shown on a graduated dimple connection 10 of the present invention. FIG. 5 illustrates that the stress in region 20 proximate to dimples 18 is distributed and lower than in the prior art dimple-connection illustrated in FIG. 2.

Figure 6:
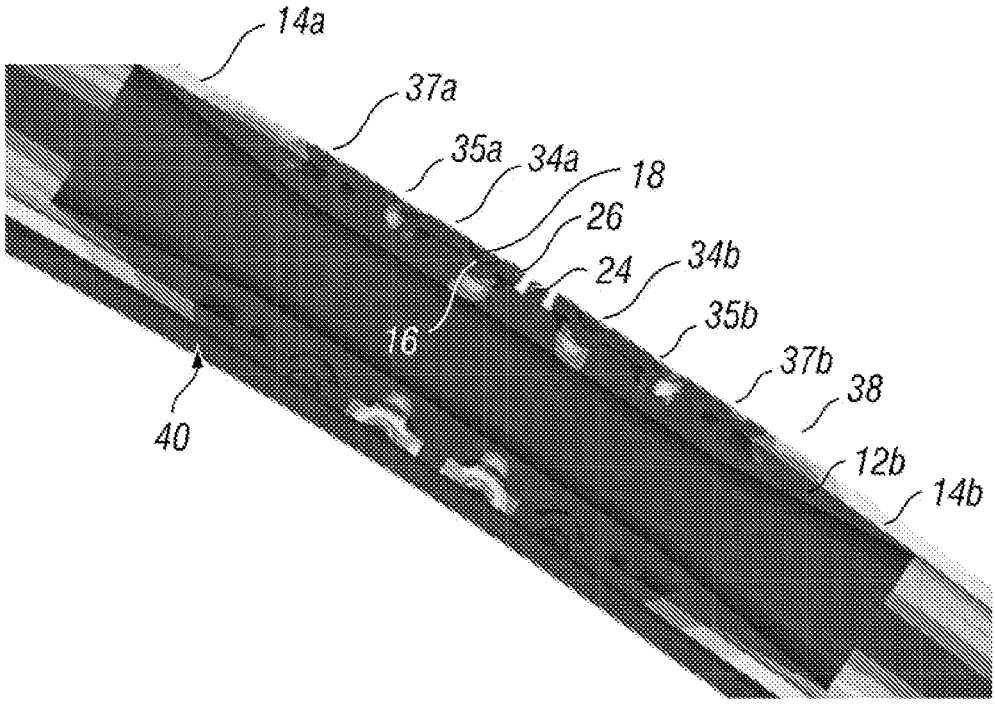
FIG. 6 (Prior Art)
FIG. 6 is a perspective view of a prior art dimple connection of a spoolable connector and coiled tubing.
Figure 7:
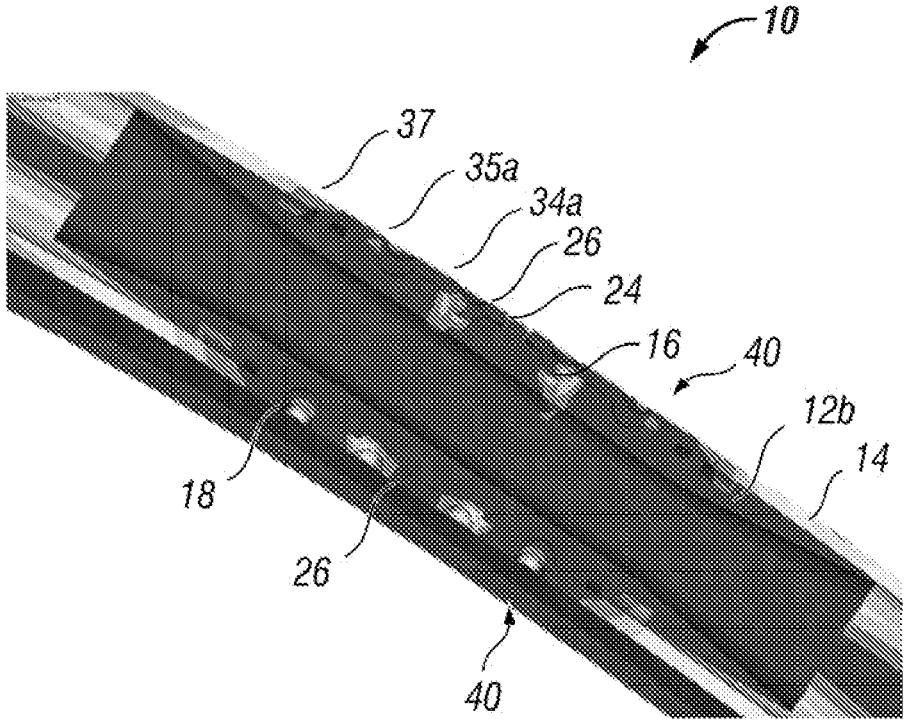
FIG. 7 is a perspective view of an embodiment of a graduated fit dimple connection of the present invention.

Referring now to FIGS. 6 and 7, wherein FIG. 6 illustrates a prior art dimple connection and FIG. 7 illustrates a graduated dimple fit connection 10 of the present invention. Similar reference numbers are used in FIGS. 6 and 7 for ease of comparison.

In FIG. 6, a spoolable connector 12 is shown connected to first and second sections of coiled tubing 14*a* and 14*b*. Each section of coiled tubing 14 is connected to connector 12 by three rows 34, 35, 37 of dimples 18 and pockets 16. Each of rows 34, 35, 37 have substantially the same loose fit between their respective dimples 18 and pockets 16. When spoolable connector 12*b* is bent around the reel or gooseneck (not shown, but well known in the art) the tensile side 38 of coiled tubing 14 tries to pull away from connector 12*b* and the compressive side 40 loads up on connector 12*b*. When the dimple 18 to pocket 16 fit is loose, as shown in FIG. 6, coiled tubing 14 is allowed to rotate relative to connector 12 causing a gap 24 to open between coiled tubing 14 and shoulder 26 along tensile side 38. Further, compressive side 40 loads past yield causing the lip of connector 12*b* to bell.

In FIG. 7, a graduated dimple connection 10 is utilized. In this embodiment, the dimple-pocket connection in first row 34 is snug, the dimple-pocket fit of second row 35 is looser than first row 34 and the dimple-pocket connection of the third row 37 is looser than second row 35. The graduated fit connection 10 limits or prevents coiled tubing 14 from rotating relative to connector 12*b* while allowing relative motion of coiled tubing 14 relative to connector 12*b* along the length of connector 12*b*. Thus, gap 24 between coiled tubing 14 and shoulder 26 is significantly reduced if not eliminated relative to the prior art connections as illustrated in FIG. 6. Further, the high compressive load on shoulder 26 on compressive side 40 is significantly reduced.

By controlling the fit of dimple 18 in the preformed pockets 16 of connector 12, the performance of connection between tubing 14 and connector 12 can be improved. Further, a graduated or progressive fit, wherein first row 34 of dimples provides a snug fit and subsequent rows of dimples introduce a small amount of slop, distributes tensile loads and bending loads which improve the performance of the connection.

The fit of dimple 18 in pocket 16 can be controlled by controlling the depth 18D of dimple 18. Measurement of dimples 18 formed in coiled tubing 14 validates that the fit meets specification. When dimples are made to the recommended depth, the connector will perform as specified.

A result of knowing the strength of a dimple based on it's measured depth is that a weak point can be designed into the coiled tubing string. A weak point would provide a connection in the string that would fail at a predetermined location and force. This is of great benefit when coiled tubing becomes stuck in the well and must be decoupled from the downhole tool string. By controlling the depth or number of dimples of equivalent depth the strength of each connection can be controlled and predicted.

Figure 8:
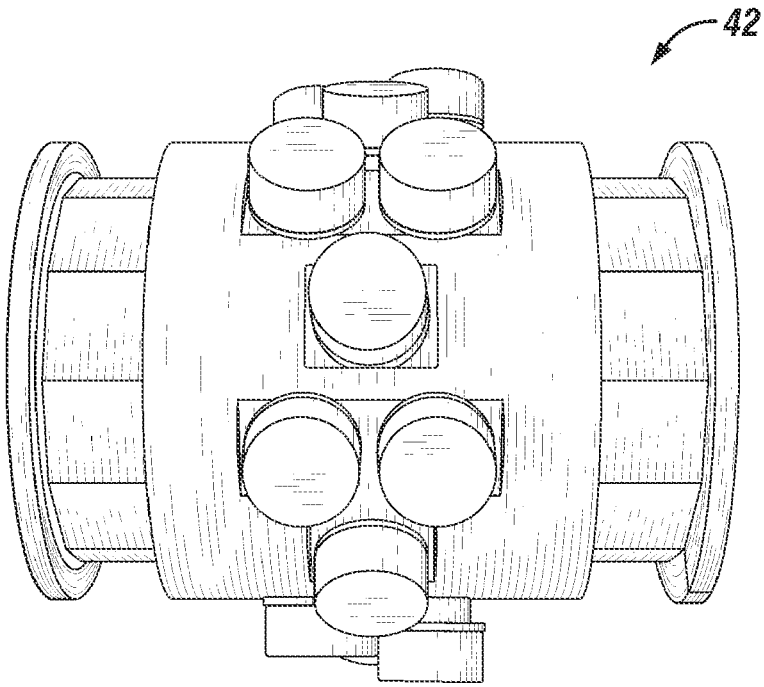
FIG. 8 is a perspective view of an embodiment of ram force dimple tool for forming dimples of the present invention.

FIG. 8 is a view of a dimple tool 42 that uses ram force to make dimples 18 have a desired depth 18D and thus radius 18R. Dimple tool 42 is adapted to control its stroke and thus dimple depth 18D. Ram force is maintained at the recommended level which insures dimple 18 is made in coiled tubing 14, but the stroke is controlled to ensure that dimple depth 18D will be within specification. A controlled dimpling depth can also be achieved by counting screw turns or limiting depth with a screw type dimpling fixture.

Figure 9:
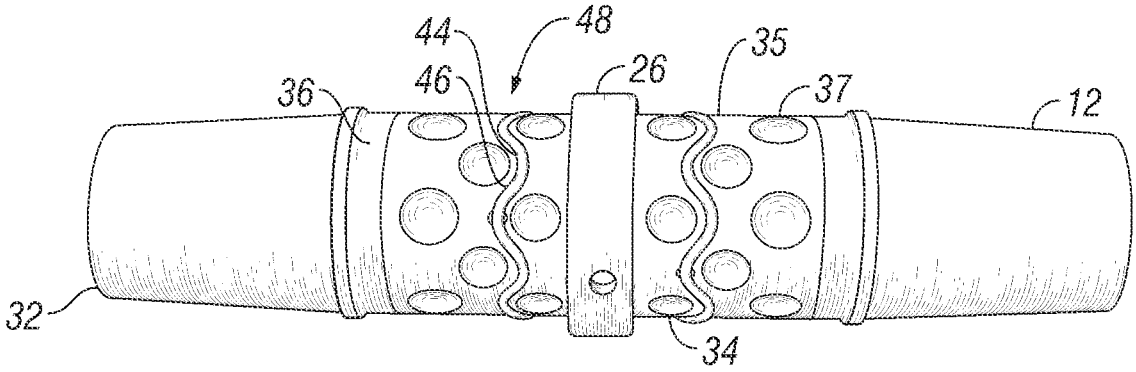
FIG. 9 is a view of an embodiment of a connector of the present invention with a serpentine seal.

FIG. 9 is a view of an embodiment of a connector 12 of the present invention having a secondary seal or barrier 48. Connector 12 includes three rows 34, 35, 37 of pockets 16. Primary seal 36 is positioned on connector 12 between terminal end 32 and last row 37 of pockets 16. A serpentine groove 44 is formed in connector 12 between at least two rows of dimples 16. In this embodiment, serpentine groove 44 is formed between first row 34 and second row 35, wherein first row 34 is intended to be a tight fit row and second row 35 is intended to be a looser fit row than first row 34. A sealing material 46, such as an O-ring, is positioned within groove 44, to provide form a secondary barrier or seal 48 with the coiled tubing when connected.

This provides a robust seal in a very stable area of connection. The location of serpentine seal 45 also allows primary seal 36 to be placed closely to the last row 37 of dimples 18, which improves seal performance in a bent condition.

From the foregoing detailed description of specific embodiments of the invention, it should be apparent that a coiled tubing dimple connection system and method that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A connection between a connector and tubing, the connection comprising:

a connector having a connection section with a terminal end;

a first row of pockets formed in the connection section;

a second row of pockets formed in the connection section positioned between the first row of pockets and the terminal end;

a tubing section positioned over the connection section of the connector;

a first row of dimples formed in the tubing section, wherein each of the first row dimples is disposed within a respective one of the first row pockets; and a second row of dimples formed in the tubing section, wherein each of the second row dimples is disposed within a respective one of the second row pockets, wherein the second row of dimples have a loose fit within their respective second row pockets relative to the fit of the first row dimples within their respective first row pockets.

2. The connection of claim 1, wherein the first row dimples have a tighter fit within their respective first row pockets than the fit of the second row dimples within their second row pockets.

3. The connection of claim 2, wherein the connector further includes a shoulder and wherein the first and second rows of dimples are positioned between the shoulder and the terminal end and the tubing section does not extend past the shoulder.

4. The connection of claim 3, further including a serpentine seal formed between the first and second rows of dimples.

5. The connection of claim 4, further including a primary seal positioned between the terminal end and the second row of dimples.

6. The connection of claim 2, further including a serpentine seal formed between the first and second rows of dimples.

7. The connection of claim 6, further including a primary seal positioned between the terminal end and the second row of dimples.

8. The connection of claim 1, further including a primary seal positioned between the terminal end and the second row of dimples.

9. The connection of claim 8, further including a secondary seal formed between the first and the second row of dimples.

10. The connection of claim 9, wherein the secondary seal is configured in a serpentine fashion.

11. The connection of claim 1, wherein the connector further includes a shoulder and wherein the first and second rows of dimples are positioned between the shoulder and the terminal end and the tubing section does not extend past the shoulder.

12. The connection of claim 1, wherein a depth of the dimples of the second row is shallower relative to their respective pocket depths than those of the first row of dimples relative to their respective pocket depths.

13. A connection between coiled tubing and a connector, the connection comprising:

a plurality of dimples formed by a tubing, each dimple being disposed within a respective pocket formed in a connector to form at least two rows of dimple-pocket connections, wherein the fit of the dimples within the pockets of the rows graduates from tighter to looser along the length of the connection, such that a radius of the dimples diverges more from their respective pocket radii than those of a previous row along the length of the connection.

14. The connection of claim 13, wherein the connector includes a shoulder and a terminal end and the connection between the tubing and the connector graduates from tighter proximate the shoulder to looser proximate the terminal end.

15. The connection of claim 14, further including a primary seal formed between the tubing and the connector positioned between the terminal end and the last of the at least two rows of dimple-pocket connections.

16. The connection of claim 13, further including a seal positioned between two of the at least two rows of dimple-pocket connections.

17. The connection of claim 16, wherein the seal is formed in a serpentine configuration.

* * * * *

UNITED STATES PATENT AND TRADEMARK OFFICE

CERTIFICATE OF CORRECTION

PATENT NO. : 7,637,539 B2
APPLICATION NO. : 11/425748
DATED : December 29, 2009
INVENTOR(S) : McKee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 720 days.

Signed and Sealed this

Ninth Day of November, 2010

David J. Kappos

David J. Kappos
*Director of the United States Patent and Trademark Office*